US007069972B1

(12) United States Patent
Edelstein

(10) Patent No.: US 7,069,972 B1
(45) Date of Patent: Jul. 4, 2006

(54) ELECTRONIC TAPE DISPENSER

(76) Inventor: Chuck Edelstein, 36 Island Ave., Miami Beach, FL (US) 33139

( * ) Notice: Subject to any disclaimer, the term of this patent is extended or adjusted under 35 U.S.C. 154(b) by 0 days.

(21) Appl. No.: 11/186,369

(22) Filed: Jul. 21, 2005

(51) Int. Cl.
*B32B 38/10* (2006.01)
*B65H 35/04* (2006.01)

(52) U.S. Cl. ..... 156/584; 156/344; 225/11; 225/18; 225/34

(58) Field of Classification Search ..... 225/10, 225/11, 14, 17, 18, 34; 156/344, 584
See application file for complete search history.

(56) References Cited

U.S. PATENT DOCUMENTS 2,574,175 A * 11/1951 Erhardt ..... 225/21
D165,656 S * 1/1952 Lathrop ..... D19/69
2,847,118 A * 8/1958 Johnson ..... 206/39.3
3,046,882 A * 7/1962 Aubrey et al. ..... 101/227
3,458,097 A * 7/1969 Palter ..... 226/135
3,747,816 A * 7/1973 Se-Kit ..... 225/11
4,462,708 A * 7/1984 Luartes et al. ..... 400/304
4,623,418 A * 11/1986 Gombrich et al. ..... 156/361
4,645,107 A * 2/1987 Norris ..... 225/37
5,048,737 A * 9/1991 Sueda et al. ..... 225/11
5,267,800 A * 12/1993 Petteruti et al. ..... 400/88

* cited by examiner

*Primary Examiner*—Mark A. Osele
(74) *Attorney, Agent, or Firm*—Robert M. Downey, PA

(57) ABSTRACT

An electrically powered tape dispenser device has a housing with a base and a top cover that opens to allow placement and removal of a tape roll supply within a tape well. Operation of a push button control actuates a motor and a pinch roller assembly to drivingly engage and pull a tape segment of select length from the roll supply for dispensing through an open mouth of the housing. The dispensed tape segment is separated from a remainder of the supply by a cutting blade fixed to the housing at the mouth. The tape segment length is preset by pushing a "count up" button to increase length or a "count down" button to decrease length. Another embodiment provides the additional function of dispensing adhesive-backed labels or stamps (e.g. postage stamps) from a roll. A lever is provided to move the pinch roller assembly into engagement with a backing strip that is pulled from the stamp roll, causing one or more stamps to be separated from the backing strip and dispensed through a stamp chute.

5 Claims, 2 Drawing Sheets

ELECTRONIC TAPE DISPENSER

BACKGROUND OF THE INVENTION

1. Field of the Invention

The present invention is directed to an automatic tape dispenser adapted to receive a supply of tape on a roll from which successive strip segments of pre-selected length are dispensed upon setting the desired segment length and operating a dispense control.

2. Discussion of the Related Art

In the past, there have been numerous types of dispensers for severing a length from a ribbon stored on a supply roll. This invention is an improvement in the field of tape dispensers, and particularly automatic tape dispensers. The dispenser of the present invention provides for the electronic input and control of dispensed tape segments of selected length. More particularly, the length of dispensed tape segments is preset by pushing either a "count up" to increase length or a "count down" to decrease length. Each push of these buttons increases or decreases the preset selected length of the tape segment to be dispensed. The dispenser of the present invention provides for the additional function of dispensing adhesive backed labels or stamps from a separate stamp dispensing chute.

OBJECTS AND ADVANTAGES OF THE INVENTION

With the foregoing in mind, it is a primary object of the present invention to provide an electronic tape dispenser which is adapted to receive a supply of tape on a supply roll from which successive strip segments of selected preset length may be dispensed upon operation of a push button control.

It is a further object of the present invention to provide an electronic tape dispenser which is structured to allow entry of a preset tape strip segment length, where upon subsequent operation of a dispense control push button serves to dispense successive strip segments of the preset length.

It is still a further object of the present invention to provide an electronic tape dispenser which is structure to permit entry of a preset tape strip segment length for subsequent dispensing upon operation of a push button control and, further, when the preset tape strip segment length can be increased or decreased in increments of 1/10 of an inch using electronic push button controls.

It is yet a further object of the present invention to provide an electronic tape dispenser which is structured for dispensing both adhesive tape in strip segments of pre-selected length as well as adhesive backed labels or stamps, such as postage stamps, from a separate stamp dispensing chute.

These and other objects and advantages of the present invention are more readily apparent with reference to the following detailed description and accompanying drawings.

SUMMARY OF THE INVENTION

Generally, the invention provides an electrically powered tape dispenser device having a housing with a base and a top cover that opens to allow placement and removal of a tape roll supply within a tape well. Operation of a push button control actuates a motor and a pinch roller assembly to drivingly engage and pull a tape segment of select length from the roll supply for dispensing through an open mouth of the housing. The dispensed tape segment is separated from a remainder of the supply by a cutting blade fixed to the housing at the mouth. The tape segment length is preset by pushing a "count up" button to increase length or a "count down" button to decrease length. Another embodiment provides the additional function of dispensing adhesive-backed labels or stamps (e.g. postage stamps) from a roll. A lever is provided to move the pinch roller assembly into engagement with a backing strip that is pulled from the stamp roll, causing one or more stamps to be separated from the backing strip and dispensed through a stamp chute.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
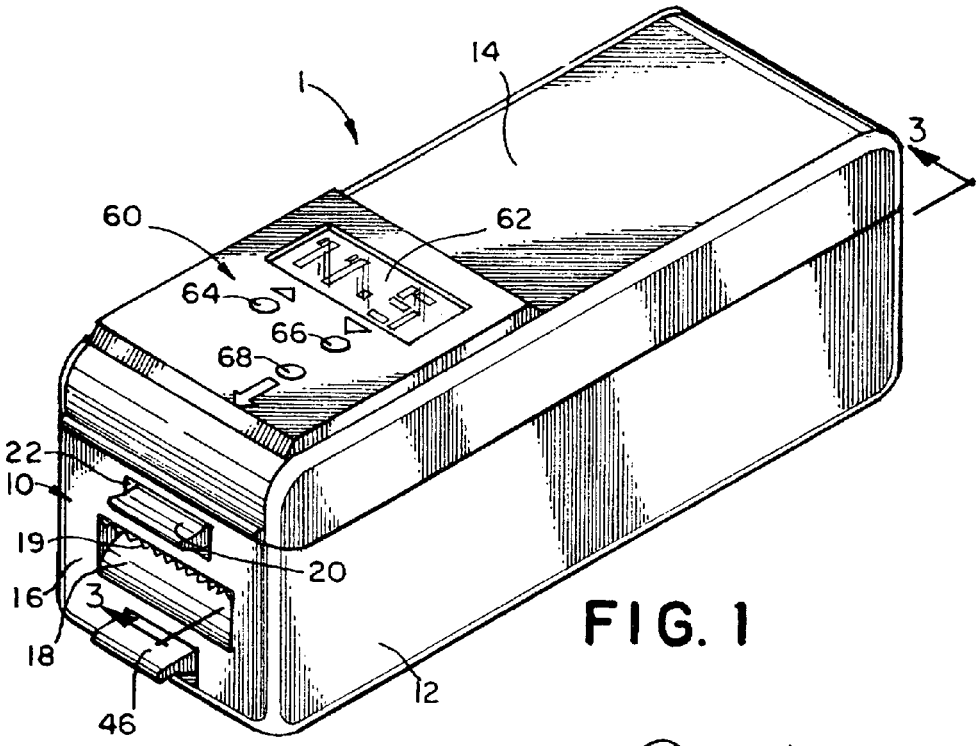
FIG. 1 is a front top perspective view of one embodiment of the electronic tape dispenser device that provides for the dual function of dispensing adhesive tape strip segments of pre-selected length, as well as the dispending of adhesive backed labels or stamps, such as postage stamps.
Figure 3:
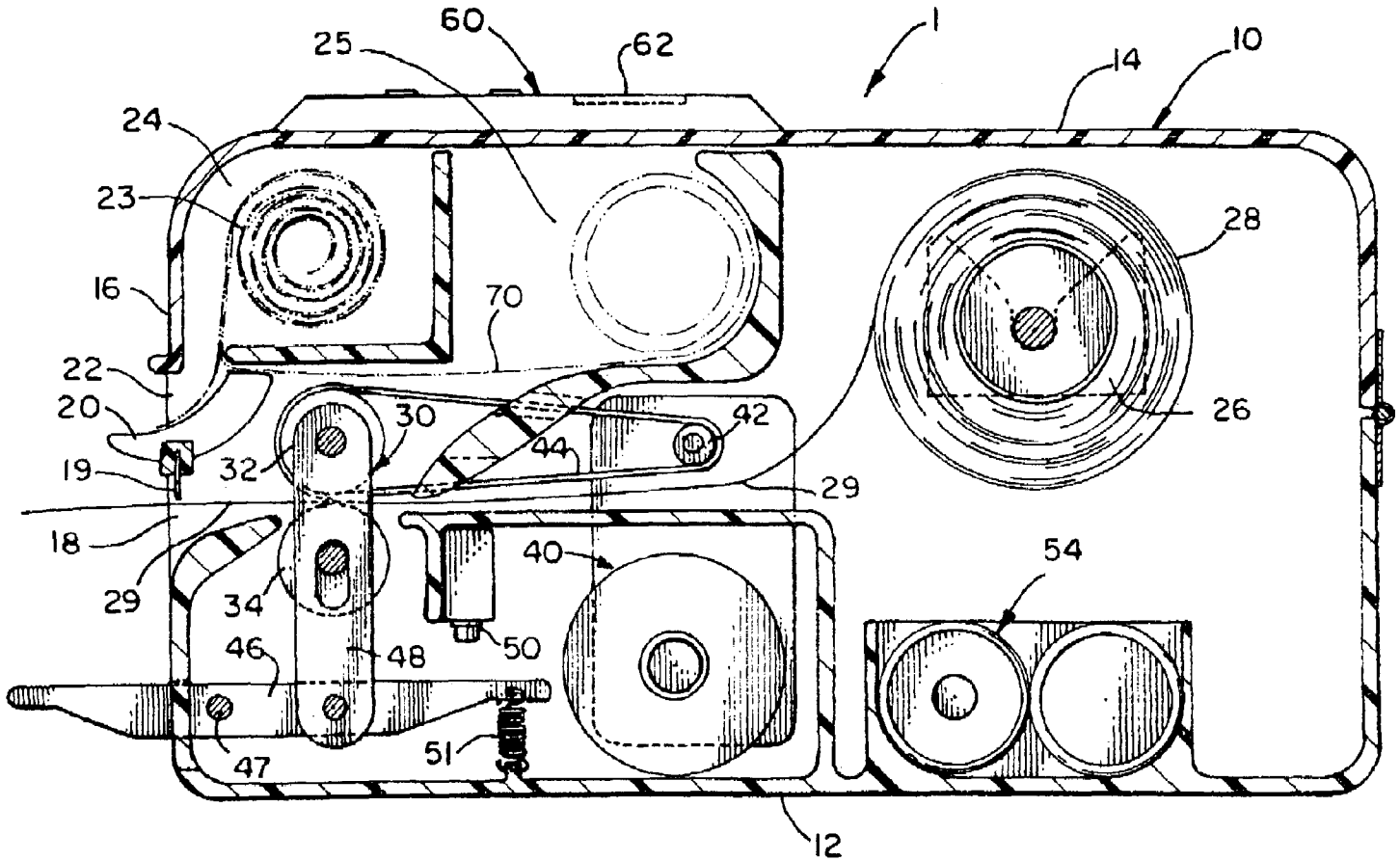
FIG. 3 is a cross-sectional view taken along the plane of the line indicated by the arrows 3—3 in FIG. 1.

Referring to the several views the drawings, and initially FIGS. 1 and 3, the electronic tape dispenser device of the present invention is shown in accordance with one embodiment thereof, and is generally indicated as 1. In this embodiment, the electronic tape dispenser 1 is adapted for dispensing both adhesive tape and adhesive-backed labels or stamps.

The electronic tape dispenser 1 as seen in FIGS. 1 and 3, includes a housing 10 with a base 12 a hinged top cover 14. The housing further includes the front end 16 with an open mouth 18 having a serrated cutting blade 19 fixed along the top of the mouth, and a stamp dispensing chute 20 positioned above the open mouth. The stamp dispensing chute 20 extends from an opening 22 on the front end 16. The top of the housing is provided with an electronic control panel 60 and a digital display 62, as described more fully hereinafter.

The top cover 14 hinges open to allow placement and removal of a tape supply roll 28 within a tape well 26. Opening the cover 14 further allows placement of a roll 23 of adhesive-backed labels or stamps within a stamp well 24. A backing strip 70, pulled from the roll 23 of labels or stamps, collects in a separate backing strip well 25. When the supply of labels or stamps has been exhausted, the cover 14 is opened and the backing strip material collected in the well 25 is removed. A new roll of adhesive backed labels or stamps can then be placed within the stamp well 24. Upon loading a new roll of labels or stamps, an end portion of the backing strip is pulled under the stamp well 24 and at least partially into the backing strip collection well 25. Similarly, when loading a new roll of tape in the tape well 26, an initial segment of tape is pulled from the roll and fed through a pinch roller assembly 30 and out from the mouth 18. Any excess tape can be cut away by lifting up against the serrated cutting blade 19.

The pinch roller assembly 30 includes two geared pinch rollers, including a fixed pinch roller 34 and a movable pinch roller controller 32. An electric motor 40 turns a geared drive wheel 42 when energized. A geared drive belt 44 drivingly engages the movable pinch roller 32 with the geared drive wheel 42 so that, upon operation of the motor 40, the movable pinch roller 32 is drivingly rotated.

Normally, the pinch rollers 32 and 34 are disposed in kissing engagement with the tape strip 29 between the rollers so that driven rotation of pinch roller 32 results in rotation of fixed pinch roller 34 in the opposite direction. The rotating pinch rollers pull the tape strip 29 from the roll and urge the tape strip 29 outwardly through the open mouth. With the speed of the motor being a constant, the length of the tape strip segment dispensed front the open mouth is dependant upon the time of operation of the motor.

The electronic controlled panel 60 is provided with a plurality of controlled push buttons including a "count up" button 64 to increase the preset length of tape strip segment to be dispensed and a "count down" button 66 to decrease the preset length of the tape strip segment to be dispensed. The electronic control panel 60 further includes a dispense push button 68. The pre-select length of tape strip segment to be dispensed is shown in the digital display 62. In the preferred embodiment, the preset length can be increased or decreased in increments of 1/10 of an inch. When the desired tape strip segment length appears in the digital display 62, the dispense push button 68 can be pushed whereupon motor 40 will be energized for a specific period of time to cause the preset length of tape strip segment to be dispensed from the open mouth. The strip segment can then be separated by lifting up and cutting against the serrated cutting blade 19.

The adhesive-backed label or stamp dispensing control assembly provides a lever 46, a linkage 48 between the lever 46 and the movable pinch roller 32, a spring 51 connected between an inner end of the lever and the housing, and a motor switch 50. An end portion of the stamp dispensing lever 46 extends outwardly from the housing. The lever 46 pivots at 47. On depressing the outer end of stamp dispensing lever 46, the inner end of the lever rises up to contact the motor switch 50. This momentarily energizes the motor 40, causing the motor gear drive wheel to rotate. The belt in turn drives the movable pinch roller 32. Simultaneously, the linkage 48 extending from the lever 46 urges the pinch roller 32 upwardly, to disengage the fixed pinch roller 34 and tape strip 29. The pinch roller 32 moves into engagement with the backing strip 70, causing the back strip 70 to be pulled from the rolled supply of adhesive-backed stamps or labels contained in the stamp well 24. While holding the lever 46 depressed with the movable pinch roller 32 in engagement with the backing strip 70, the backing strip is pulled from the supply roll and collects in the backing strip well 25. In the same operation, the adhesive-backed stamp or label is separated from the backing strip 70 at the top end of the stamp dispensing chute 20 where the backing strip makes an abrupt turn. The stamp or label is then released down the stamp chute 20 and dispensed out through the stamp dispenser opening 22. When downward pressure on the outside end of the stamp dispensing lever 46 is released, the spring 51 pulls the inner end of the lever down to release the switch 50, thereby stopping the motor 40. The motor 40, control panel 60 and digital display 62 are powered by a battery power source 54. Alternatively, the electric components of the device maybe powered by an A/C power source using an electric cord and plug.

Figure 2:
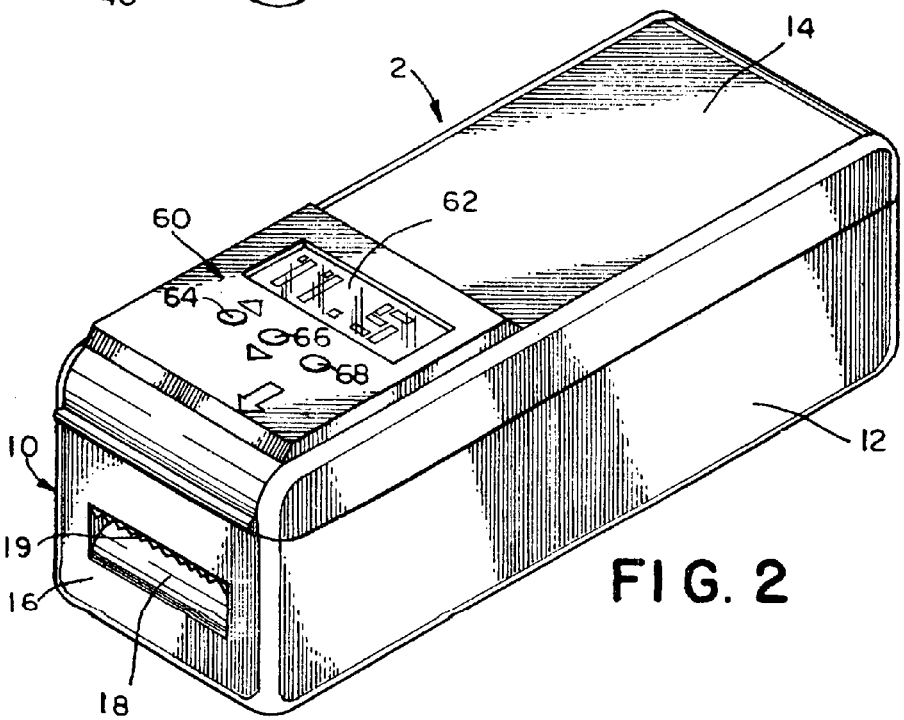
FIG. 2 is a front top perspective view of another embodiment of the present invention, wherein the electronic tape dispenser is adapted for dispensing successive tape strip segments of pre-selected length.

The embodiment shown in FIG. 2, generally indicated as 2, provides for tape dispensing only and includes the same components for tape dispensing as described in connection with the embodiment of FIGS. 1 and 3. The embodiment of FIG. 2 does not have the lever and stamp holding and dispensing features. Additionally, both of the pinch rollers 32 and 34 are fixed in position and in kissing engagement with one another.

While the present invention has been shown and described in accordance with preferred and practical embodiments thereof, it is recognized that the departures from the instant disclosure are contemplated with the spirit and scope of the present invention which is not intended to be limited except as defined in the following claims as interpreted on a doctrine of equivalents.

What is claimed is:

1. A device for dispensing segments of tape strip pulled from a tape roll, said device comprising:

a housing with an open mouth and an interior;

a tape well within said housing interior for rotatably supporting the tape roll;

a pinch roller assembly for engaging and pulling a strip of tape from the tape roll and directing the strip of tape outwardly through said open mouth, and said pinch roller assembly including a first pinch roller in driven engagement with said motor, a second pinch roller in kissing engagement with said first pinch roller, and said first and second pinch rollers being structured and disposed to counter-rotate relative to one another so that with the strip of tape passing between said first and second pinch rollers and said first and second pinch rollers engaging opposite sides of the strip of tape, the strip of tape is pulled from the tape roll upon driven, counter-rotation of said first and second pinch rollers, and said first pinch roller being movable into and out of kissing engagement with said second pinch roller;

a motor for driving rotation of said pinch roller assembly to pull the strip of tape from the tape roll;

a controller including a plurality of control buttons and a display on an exterior of said housing, and said plurality of control buttons including at least one button for selecting the length of the segment of tape strip to be dispensed through said open mouth, and said display being adapted to visually indicate the selected segment length of tape strip to be dispensed, and said plurality of control buttons further including a dispense control button for energizing said motor in order to drive rotation of said pinch roller assembly;

said controller being structured and disposed to control the duration of actuation of said motor to correspond with the selected segment length of tape strip to be dispensed so that, upon operation of said dispense button said motor is energized for a controlled duration of time during which said pinch roller assembly pulls the strip of tape from the tape roll and dispenses the selected segment length of tape strip through said open mouth;

a stamp well within said housing interior for holding a roll of releasable backing material having a plurality of adhesive-backed substrate members removably attached thereto;

a dispensing chute communicating with said stamp well;

a backing material collection chamber;

said first pinch roller being structured and disposed to move into engagement with a strip of said releasable backing material to pull said strip from said roll and to cause said adhesive-backed substrate members to be separated from said strip of backing material and released down said dispensing chute; and a lever for selectively moving said first pinch roller between a first position in kissing engagement with said second pinch roller and a second position in engagement with said strip of releasable backing material.

2. The device as recited in claim 1 wherein said plurality of control buttons of said controller include a count up button for increasing the selected segment length of tape strip to be dispensed and a count down button for decreasing the selected segment length of tape strip to be dispensed.

3. The device as recited in claim 2 wherein said controller is structured and disposed to selectively increase and decrease the selected segment length of tape strip to be dispensed in fixed increments.

4. The device as recited in claim 1 wherein said lever is further structured for actuating said motor upon moving to said second position, thereby drivingly engaging and rotating said first pinch roller to pull said strip from said roll.

5. A device for dispensing segments of tape strip pulled from a tape roll, said device comprising:

a housing with an open mouth and an interior;

a tape well within said housing interior for rotatably supporting the tape roll;

a pinch roller assembly for engaging and pulling a strip of tape from the tape roll and said pinch roller assembly including a first pinch roller in driven engagement with said motor, a second pinch roller in kissing engagement with said first pinch roller, and said first and second pinch rollers being structured and disposed to counter-rotate relative to one another so that with the strip of tape passing between said first and second pinch rollers and said first and second pinch rollers engaging opposite sides of the strip of tape, the strip of tape is pulled from the tape roll upon driven, counter-rotation of said first and second pinch rollers, and said first pinch roller being movable into and out of kissing engagement with said second pinch roller;

a controller for selecting the length of the segment of tape strip to be dispensed through said open mouth, and said controller being further structured and disposed for energizing said motor in order to drive rotation of said pinch roller assembly, thereby dispensing the selected segment length of tape strip through said open mouth, and said controller being structured and disposed to selectively increase and decrease the selected segment length of tape strip to be dispensed in fixed increments;

a stamp well within said housing interior for holding a roll of releasable backing material having a plurality of adhesive-backed substrate members removably attached thereto;

a dispensing chute communicating with said stamp well;

a backing material collection chamber;

said first pinch roller being structured and disposed to move into engagement with a strip of said releasable backing material to pull said strip from said roll and to cause said adhesive-backed substrate members to be separated from said strip of backing material and released down said dispensing chute;

a lever for selectively moving said first pinch roller between a first position in kissing engagement with said second pinch roller and a second position in engagement with said strip of releasable backing material; and said lever being further structured for actuating said motor upon moving to said second position, thereby drivingly engaging and rotating said first pinch roller to pull said strip from said roll.

* * * * *